US008544678B1

(12) United States Patent
Hughes

(10) Patent No.: US 8,544,678 B1
(45) Date of Patent: Oct. 1, 2013

(54) INSULATED CAN AND LONGNECK BOTTLE BEVERAGE CONTAINER HOLDER

(76) Inventor: Elliott Stanley Hughes, Indianapolis, IN (US)

( * ) Notice: Subject to any disclaimer, the term of this patent is extended or adjusted under 35 U.S.C. 154(b) by 142 days.

(21) Appl. No.: 12/932,231

(22) Filed: Feb. 22, 2011

(51) Int. Cl.
*B65D 23/08* (2006.01)

(52) U.S. Cl.
USPC ..... 220/739; 220/737; 220/902; 220/903

(58) Field of Classification Search
USPC ..... 220/592.16, 737, 739, 592.2, 592.24, 220/592.25, 902, 903; 215/386, 387
See application file for complete search history.

(56) References Cited

U.S. PATENT DOCUMENTS

| | | | | |
|---|---|---|---|---|
| 3,090,478 | A * | 5/1963 | Stanley | 248/128 |
| 4,456,134 | A * | 6/1984 | Cooper | 215/341 |
| 4,648,525 | A * | 3/1987 | Henderson | 220/739 |
| 4,708,254 | A * | 11/1987 | Byrns | 215/13.1 |
| 4,838,466 | A * | 6/1989 | Holmstrom | 224/250 |
| 5,022,235 | A * | 6/1991 | Grissom | 62/457.4 |
| 5,390,804 | A * | 2/1995 | Beggins | 215/386 |
| 5,497,902 | A * | 3/1996 | Crock | 220/737 |
| 5,669,538 | A | 9/1997 | Ward | |
| 5,845,806 | A | 12/1998 | Parchman | |
| 6,349,846 | B1 | 2/2002 | Meza | |
| 6,554,155 | B1 * | 4/2003 | Beggins | 220/739 |
| 6,571,976 | B1 | 6/2003 | Sonnabend | |
| 6,799,693 | B2 | 10/2004 | Meza | |
| 6,814,252 | B2 | 11/2004 | Murakami et al. | |
| 6,851,276 | B2 | 2/2005 | Perrins | |
| D505,300 | S * | 5/2005 | Walsh | D7/608 |
| 7,201,285 | B2 * | 4/2007 | Beggins | 215/386 |
| 7,219,814 | B2 | 5/2007 | Lown et al. | |
| 7,228,987 | B2 | 6/2007 | Jones | |
| 7,614,516 | B2 * | 11/2009 | Beggins | 215/386 |
| 2002/0113072 | A1 * | 8/2002 | Lane | 220/739 |
| 2003/0230511 | A1 * | 12/2003 | Meza | 206/545 |
| 2004/0011802 | A1 | 1/2004 | Findlay et al. | |
| 2006/0043097 | A1 * | 3/2006 | Tulp | 220/737 |
| 2007/0017924 | A1 * | 1/2007 | Hundley | 220/737 |
| 2007/0289982 | A1 * | 12/2007 | Mandachescu | 220/737 |
| 2009/0242578 | A1 * | 10/2009 | Bonilla | 220/739 |
| 2010/0301053 | A1 * | 12/2010 | Willis et al. | 220/560 |

FOREIGN PATENT DOCUMENTS

| | | |
|---|---|---|
| GB | 2221292 | 1/1990 |
| JP | 10-17033 | 1/1998 |
| JP | 2006248608 | 9/2006 |

* cited by examiner

*Primary Examiner* — Anthony Stashick
*Assistant Examiner* — Robert Stodola
(74) *Attorney, Agent, or Firm* — Ice Miller LLP

(57) ABSTRACT

An insulating beverage container holder is disclosed that is adapted to receive either longneck beverage bottles or aluminum cans. The insulating beverage holder consists of a substantially cylindrical body having 3 axially aligned apertures therein. One aperture is sized for an interference fit with the cylindrical diameter of an aluminum can beverage container. A second aperture is sized for an interference fit with the neck portion of a longneck beverage container. A third aperture, situated between the first and second apertures, is sized for an interference fit with the larger diameter of a longneck beverage container. Retaining mechanisms are also disclosed that secure longneck beverage containers within the holder to prevent inadvertent removal of the beverage container from within the insulated beverage container holder.

18 Claims, 7 Drawing Sheets

INSULATED CAN AND LONGNECK BOTTLE BEVERAGE CONTAINER HOLDER

FIELD OF THE INVENTION

This invention relates in general to insulated beverage or drink holders and more particularly to an insulated beverage container holder adapted for use with both single diameter beverage containers and longneck bottle beverage containers where the larger diameter of the two c containers are different.

BACKGROUND OF THE INVENTION

A number of insulating enclosures or containers configured to receive and insulate a beverage container are well known in the art. The simplest of such insulating containers typically includes a cylindrical external shape having a cylindrical cavity for receiving a cylindrical beverage container therein. The insulating enclosures of the prior art are typically constructed of a flexible material having good insulating characteristics. The cylindrical opening is typically sized to receive either an aluminum can or a longneck glass or plastic bottle and gently grip the external cylindrical surface of the beverage container. Such devices are useful in maintaining the temperature of the beverage container situated within the insulating container. A few examples of such are shown in U.S. Pat. Nos. 7,228,987, 6,814,252, 6,799,693, 6,571,976, 6,349,846, 5,845,806, and 5,669,538.

A typical aluminum can beverage container produced in the United States has an external cylindrical diameter that is slightly larger than the typical longneck bottle beverage container. As a result of the differential in diameter between the two most commonly produced beverage containers, beverage insulators are typically designed to hold either an aluminum can beverage container or a longneck bottle beverage container. The insulating container sized to receive an aluminum beverage can will obviously also receive a longneck bottle beverage container, yet the bottle will be loosely received therein resulting in a less than ideal "fit"; and if the longneck beverage container is held by the smaller diameter neck portion, the insulating container will fall off of the longneck bottle due to the loose fit.

What is needed is an insulating beverage container holder adapted to securely receive both a metal can and a longneck bottle beverage container.

SUMMARY OF THE INVENTION

An insulating beverage container holder for use with a cylindrical beverage container and a longneck beverage container, according to one aspect of the present invention, comprises a body consisting of a flexible resilient insulating material and having a top surface and a bottom surface and wherein the top surface and the bottom surface are disposed in spaced apart parallel planes, a first aperture disposed in the bottom surface of the body that is sized for an interference fit with the diameter of the cylindrical beverage container, a second aperture disposed in the top surface of the body that is sized for an interference fit with the neck portion of the longneck beverage container, and a third aperture situated within the body and in fluid communication with the first and the second apertures, and wherein the third aperture is sized for an interference fit with the larger diameter of the longneck beverage container.

One object of the present invention is to provide an improved insulating beverage container holder.

Another object of the present invention is to provide an insulating beverage container holder that is adapted for use with both longneck bottles and cylindrical can beverage containers.

Another object of the present invention is to provide an economical insulating beverage container that includes features to secure glass bottle beverage containers within the device.

These and other objects of the present invention will become more apparent from the following drawings and description of the preferred embodiments.

DESCRIPTION OF THE PREFERRED EMBODIMENTS

Figure 1:
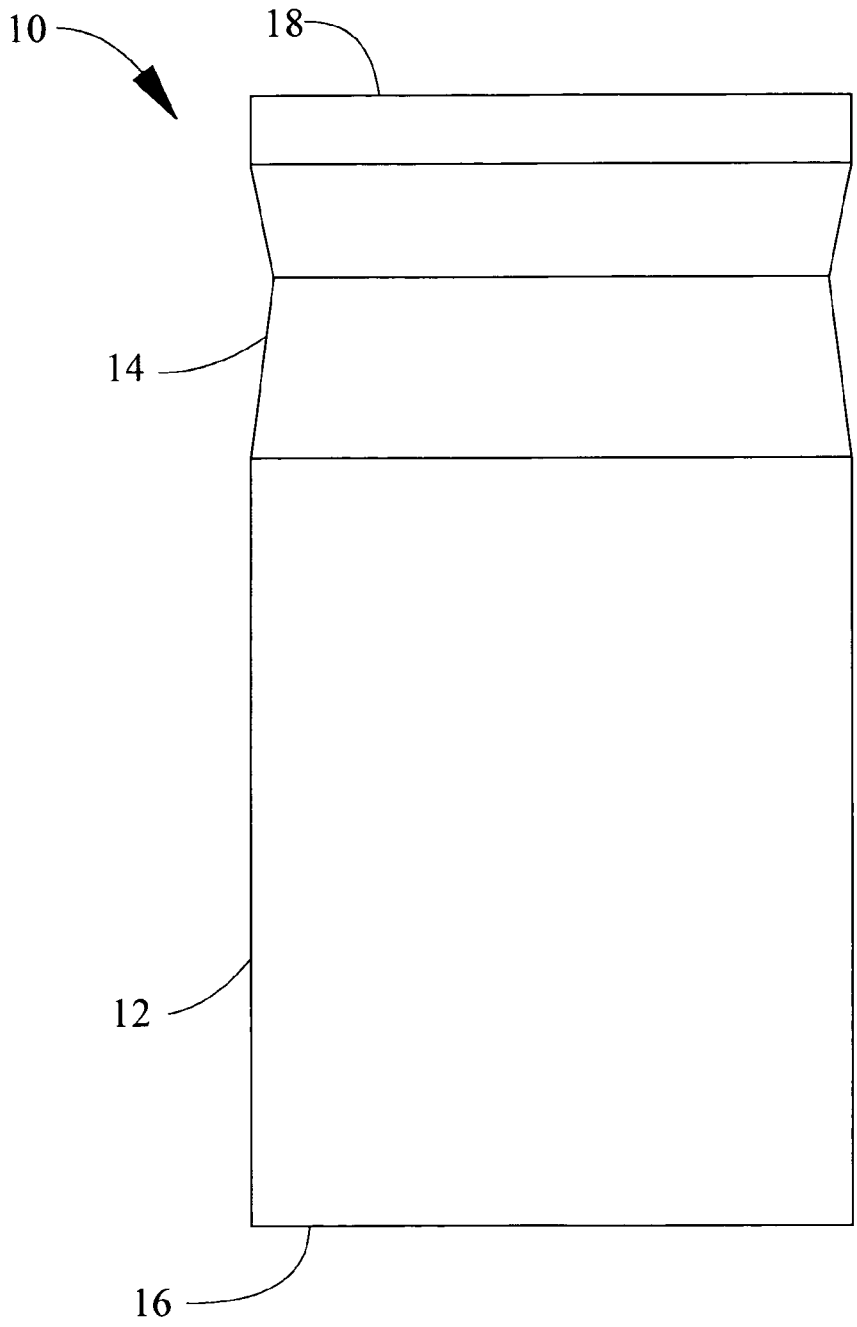
FIG. 1 is a front elevational view of an insulating beverage container holder according to one aspect of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an insulated beverage container holder 10 according to one aspect of the present invention is shown. Holder 10 has a generally cylindrical lateral surface 12. An indented surface 14 serves to provide a convenient gripping area for a user to grasp holder 10 by the hand. Base surface 16 and top surface 18 are planar circular surfaces having cylindrical apertures extending therein (apertures are shown in detail in FIGS. 2-4). Planar surfaces 16 and 18 are situated in parallel spaced apart planes.

Figure 2:
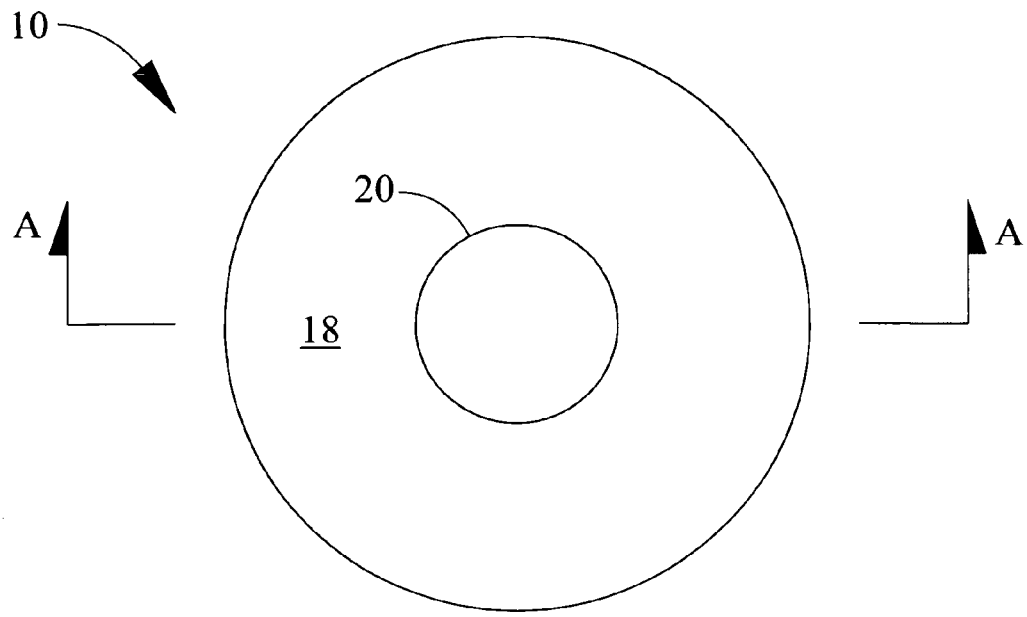
FIG. 2 is a plan view of the insulating beverage container holder of FIG. 1.
Figure 3:
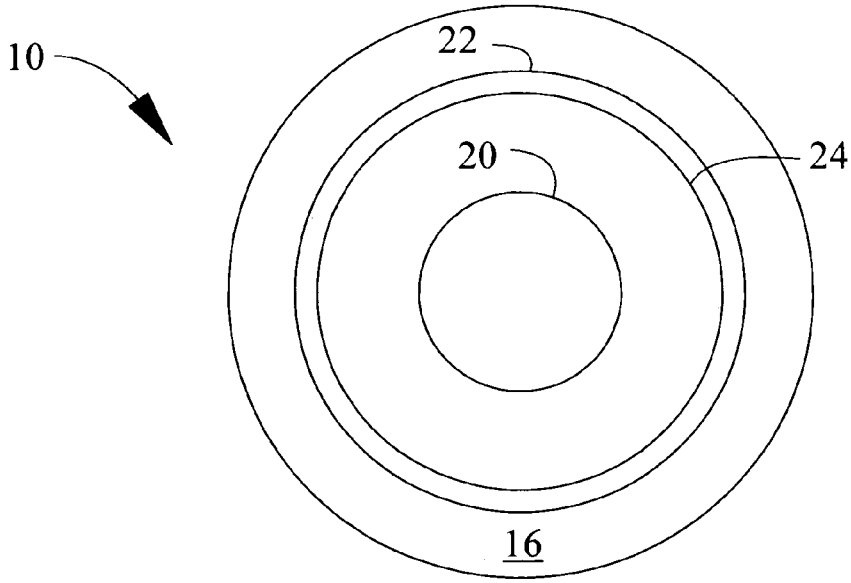
FIG. 3 is a bottom view of the insulating beverage container holder of FIG. 1.

Referring now to FIGS. 2 and 3, a plan view and a bottom view of holder 10 are respectively shown. FIG. 2 depicts circular top surface 18 that includes a cylindrical aperture 20 extending downward into holder 10. The radius of aperture 20 is sized to have an interference fit with the neck portion of a longneck beverage container. Cylindrical aperture 22 extends into base 16 as shown in FIG. 3. Aperture 22 has a radius sized for an interference fit with a typical aluminum can beverage container, such as a soda or beer can. Cylindrical aperture 24 is situated within device 10 and between apertures 20 and 22, and is in fluid communication with apertures 20 and 22. Aperture 24 has a diameter sized for an interference fit with the largest diameter of a longneck bottle beverage container.

Figure 4:
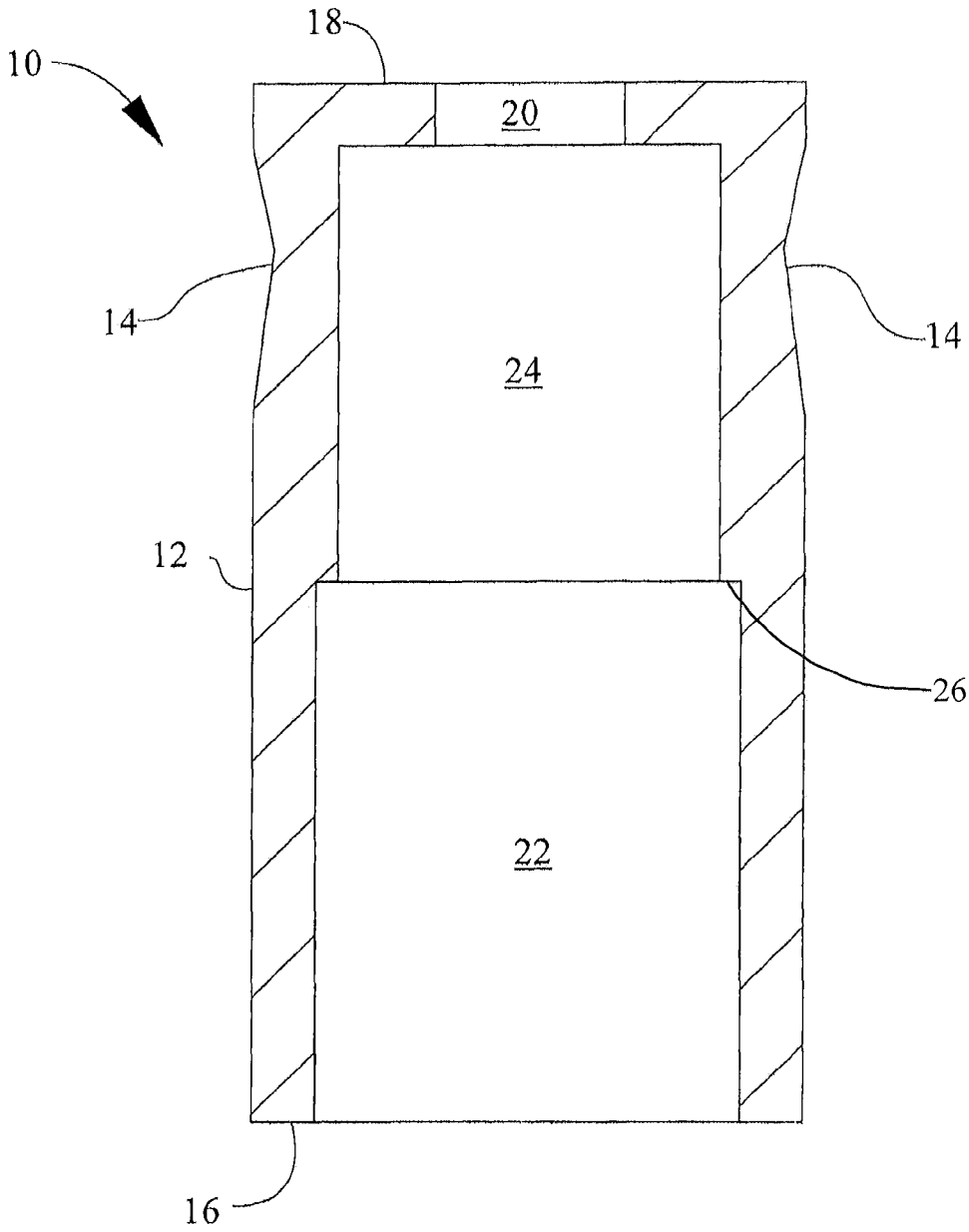
FIG. 4 is a cross-sectional view of the insulating beverage container holder of FIG. 2 looking in the direction of the arrows labeled A in FIG. 2.

Referring now to FIG. 4, a cross-sectional view of holder 10 looking in the direction of the arrows labeled A of FIG. 2 is shown. Lateral surface 12, base 16 and top 18 are shown. Apertures 20, 22 and 24 are more clearly defined by reference to this view depicting the position, height and diameter of each aperture with respect to holder 10. Apertures 20, 22 and 24 are axially aligned cylindrical apertures in fluid communication with one another within container holder 10. The difference in diameter between aperture 22 and aperture 24 results in a shoulder 26 disposed at the interface therebetween. Indentation 14 is also shown.

Holder 10 is constructed of any of the materials well known in the art of insulated beverage holders, including open cell foam, closed cell foam, vinyl coated soft foam, neoprene foam or any other materials known in the art having resilient and compressible characteristics as well as good insulating properties.

Figure 5:
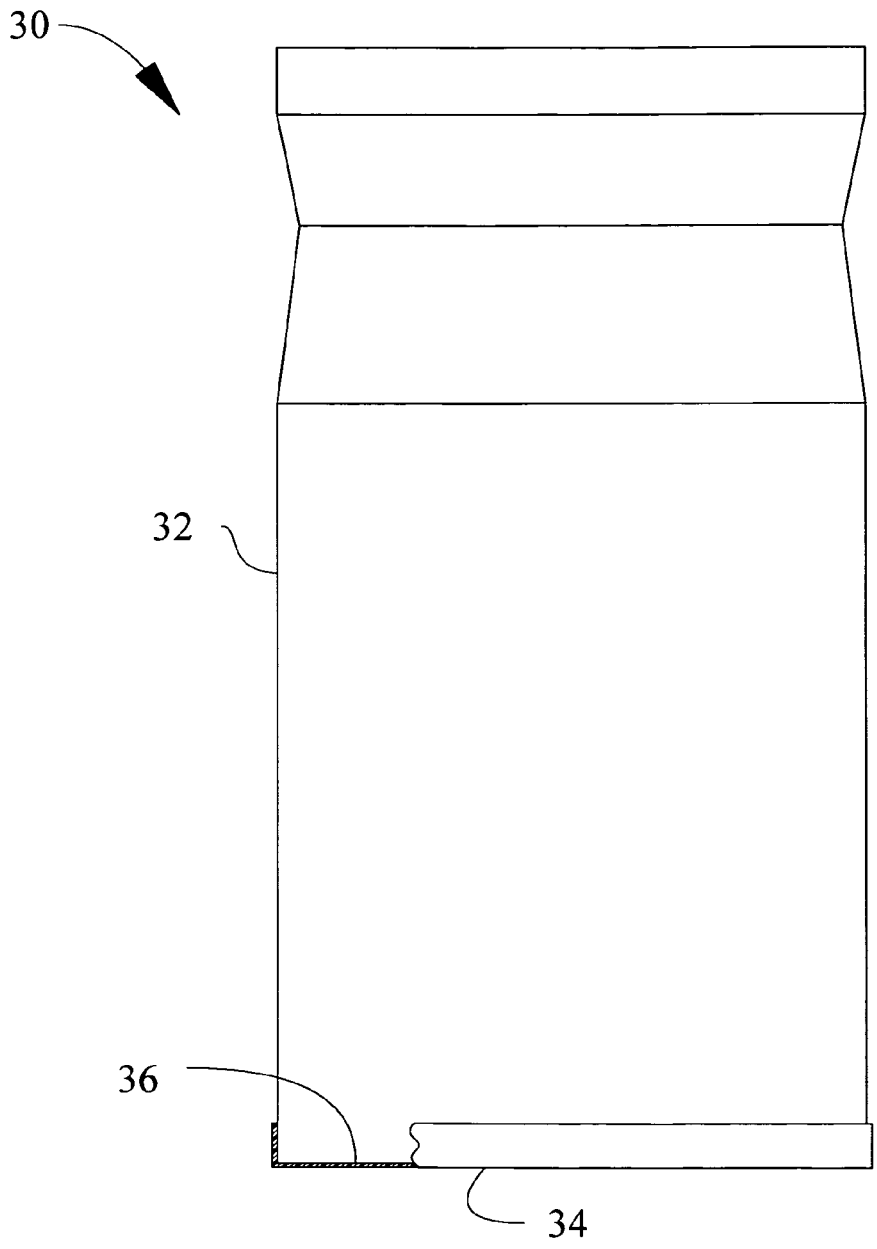
FIG. 5 is a partial cutaway front elevational view of an insulating beverage container holder according to a second aspect of the present invention.

Referring now to FIG. 5, another embodiment of an insulated beverage container holder 30 according to another aspect of the present invention is shown. Holder 30 includes a beverage container holder 32 and a retaining device 34. Holder 32 is identical with and includes all of the features of device 10 shown in FIGS. 1-4. Retaining device 34 consists of a cylindrical ring attached to base 36 of holder 32. Retaining device 34 includes a specially configured aperture for easy insertion and removal of a longneck beverage container within holder 32. Retaining device 34 is shown in more detail in FIGS. 6 and 7.

Figure 6:
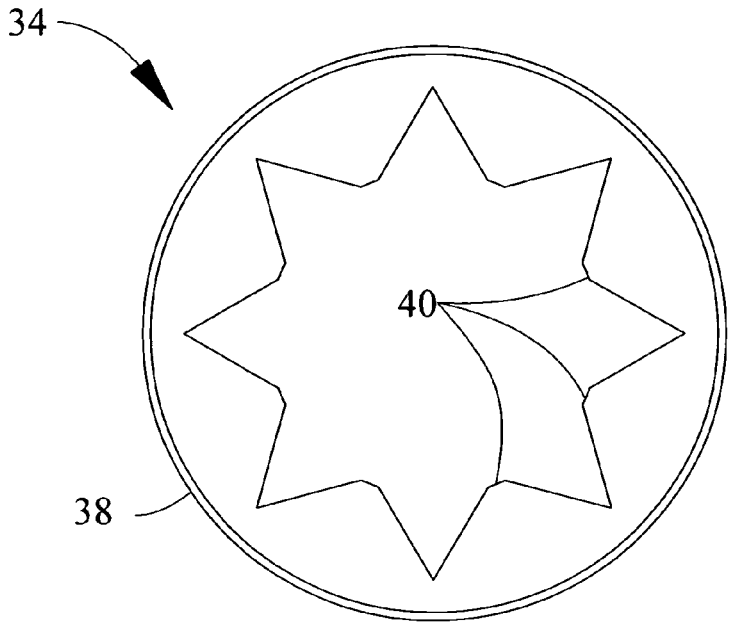
FIG. 6 is a plan view of a beverage retaining ring for use with the insulating beverage container holder of FIG. 5.
Figure 7:
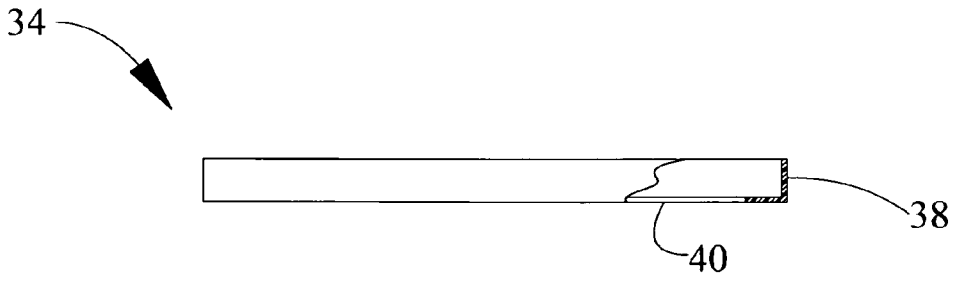
FIG. 7 is a partial cross-sectional side elevational view of the ring shown in FIG. 6.

Referring now to FIGS. 6 and 7, retaining device or retaining ring 34 is shown. FIG. 6 is a plan view of retaining ring 34 and FIG. 7 is a side view including a partial cross-sectional view through the central portion of ring 34. Ring 34 includes a vertical wall 38 extending around the outer periphery of ring 34. The inner diameter of wall 38 surrounds and makes contact with base 36 of holder 32. Ring 34 fits snugly against the lateral surface of beverage holder 32. Retaining flaps 40 extend inward from vertical wall 38 and are resilient to allow a longneck bottle beverage container to pass centrally therethrough when sufficient force is applied to the beverage container to deflect flaps 40 during insertion or removal of the beverage container within the internal apertures of holder 32. Preferably, retaining device 34 is attached to holder 32 using a suitable adhesive applied about the inner periphery of vertical wall 38.

Figure 8:
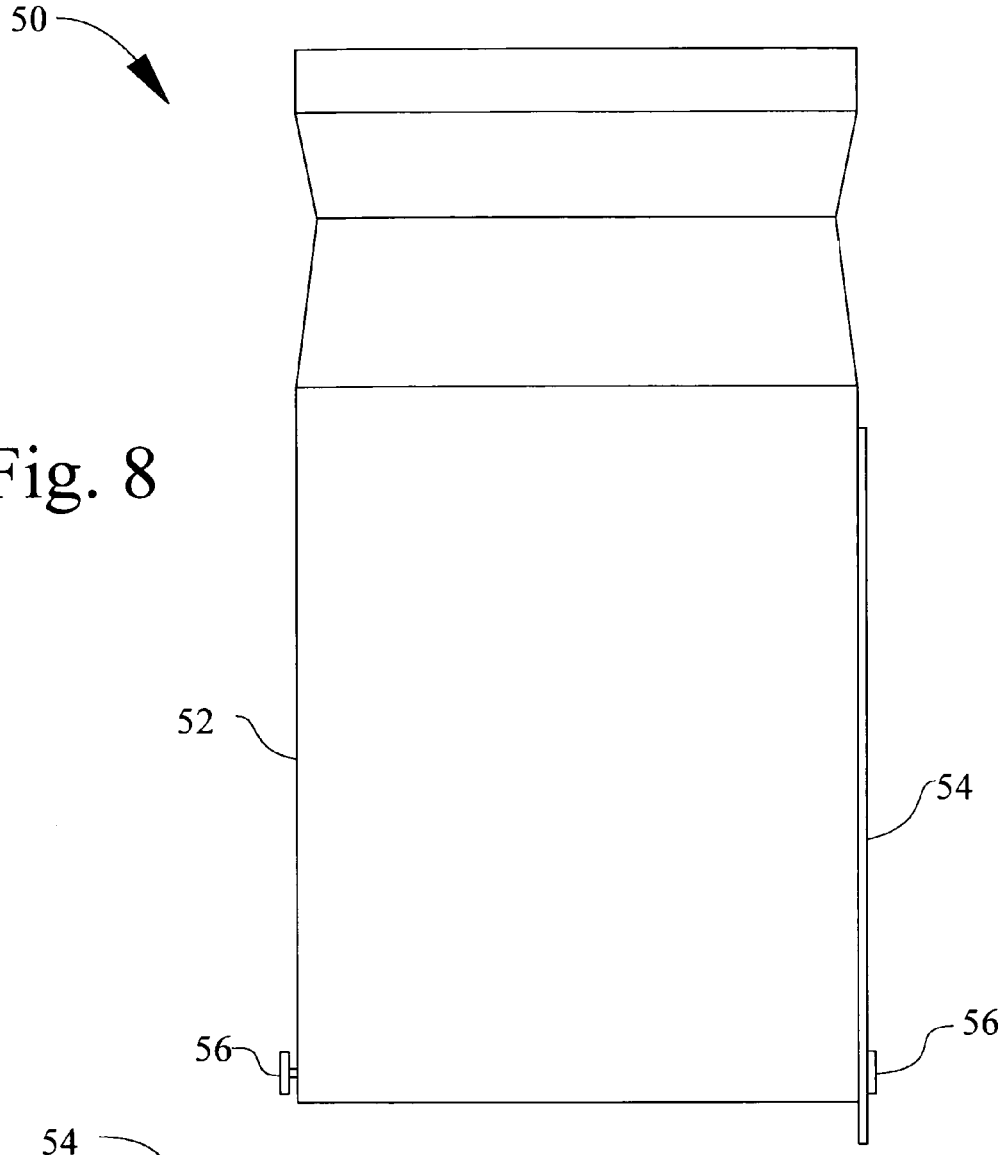
FIG. 8 is a front elevational view of an insulating beverage container holder according to a third aspect of the present invention.
Figure 9:
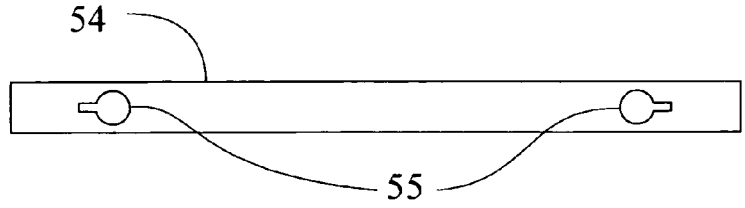
FIG. 9 is a plan view of an elastic strap removably attachable to the device shown in FIG. 8.
Figure 10:
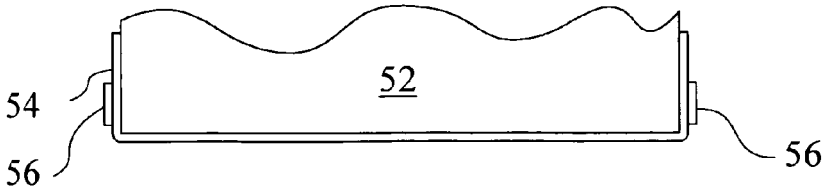
FIG. 10 is a partial front elevational view of the device of FIG. 8 depicting the elastic strap of FIG. 9 attached to the insulating beverage container holder of FIG. 8.

Referring now to FIGS. 8-10, an insulating beverage container holder 50 according to another aspect of the present invention is shown. FIG. 8 is a front elevational view of holder 52 with strap 54 attached to only one of the two mounting buttons 56. Holder 52 is identical in all respects with the features and construction of device 10 of FIG. 1. A longneck beverage container is inserted into the internal apertures of holder 52 when strap 54 is detached from at least one of the buttons 56, as shown. FIG. 9 is a plan view of retaining strap 54, a thin rectangular strip of flexible material having apertures 55 therein. Strap 54 is mounted on buttons 56 as shown in FIGS. 8 and 10. It is contemplated that strap 54 may also have resilient properties such as are found in a rubber band. Buttons 56 are permanently affixed to holder 52 using adhesives, integral molding techniques, with rivets or any other technique will known in the art of affixing a button to an article. FIG. 10 depicts strap 54 mounted on rivets 56 and extending across the base or bottom surface of holder 52 thereby safely retaining a longneck beverage container within the internal apertures of holder 52.

Figure 11:
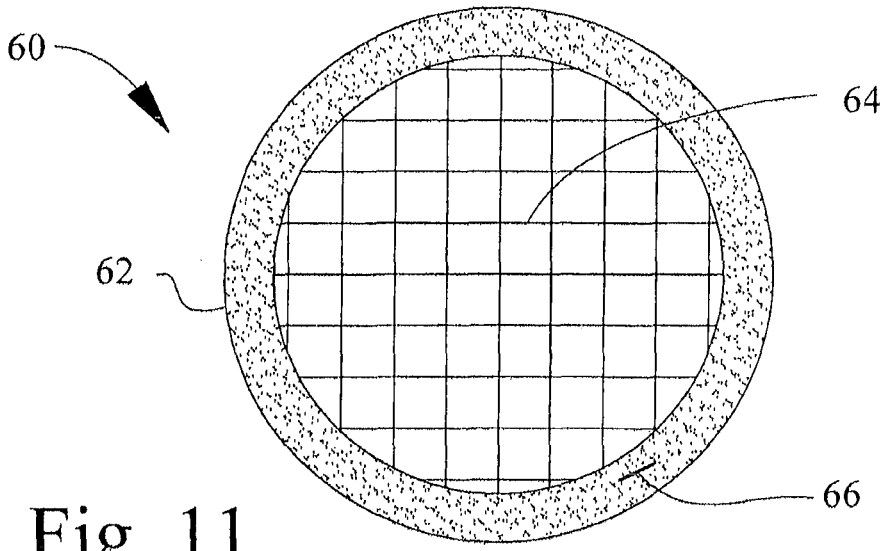
FIG. 11 is another embodiment of a retaining ring for use with the insulating beverage container holder of FIG. 5.

Referring now to FIG. 11, another embodiment of a retaining device 60 for use with insulated beverage container holder 10 is shown. Retaining device 60 is comprised of a disk or ring 62 having a cross-hatched netting 64 attached at the periphery of ring 62. Netting 64 may be thin mono-filament material attached to ring 62 or integrally molded plastic filaments formed into ring 62. One portion of a hook and loop fastener 66 is attached to the surface of device 60 as shown. The mating portion of the hook and loop fastener 66 is attached to base 16 of beverage holder 10 (as shown in FIG. 12) so that device 60, when attached to holder 10, provides a readily removable retention means for securing a longneck beverage within the internal apertures of holder 10.

Figure 12:
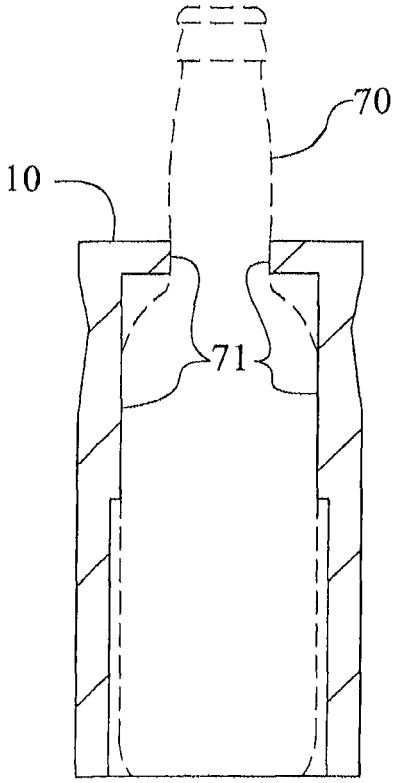
FIG. 12 is a cross-sectional view of the device of FIG. 1 depicting, by way of broken lines, a longneck beverage container situated within the device.

Referring now to FIG. 12, a cross-sectional view of holder 10 is shown depicting a longneck beverage container 70 situated within the internal apertures of holder 10. The interference fit discussed above between the beverage container and holder 10 is found at locations 71. The interference fit assists in retaining container 70 securely within holder 10 as a user enjoys the beverage in container 70.

Figure 13:
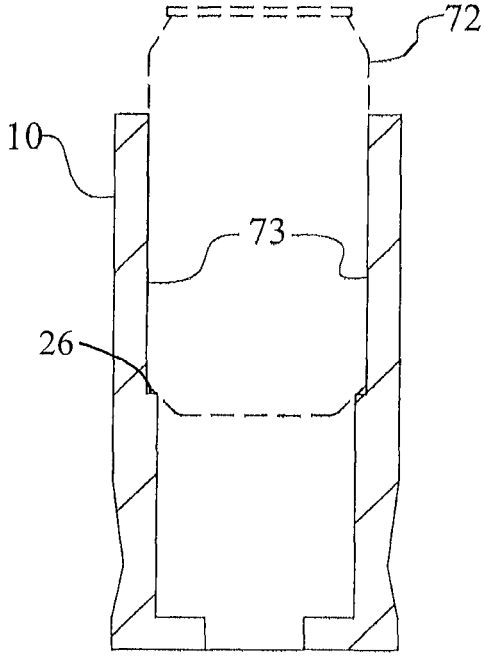
FIG. 13 is a cross-sectional view of the device of FIG. 1 depicting, by way of broken lines, a metal can beverage container situated within the device.

Referring now to FIG. 13, a cross-sectional view of holder 10 is shown depicting an aluminum can beverage container 72 situated within the internal apertures of holder 10. The interference fit discussed above is found at locations 73, specifically, between the inner walls of holder 10 and the lateral surface of the aluminum can beverage container. The interference fit creates a gripping force between container 72 and holder 10 to retain container 72 within holder 10. Further, the shoulder 26 may at least partially support the aluminum can beverage container 72 as shown in FIG. 13.

It is contemplated that a retaining disk attached to the bottom surface of the embodiments shown may also include a hinge and a latch to secure the retaining disk in a closed position adjacent the bottom surface of the insulating body yet enable the disk to be pivoted into an open position for insertion of a beverage container into the body of the holder. It is also contemplated that a variety of mechanisms may be employed to retain a longneck beverage container within the embodiments shown, including, but not limited to, projections extending inward about the periphery of aperture 22 and integrally molded into the body of holder 10, spring loaded pins or levers attached to holder 10 and extending partially over aperture 22 at the base of holder 10, or a disk pivotally attached to base 16 over aperture 22 and rotatable about a pivot pin to allow access to aperture 22 in a first pivot position and to cover aperture 22 in a second pivot position and including mechanical mechanisms to positively retain the disk in position over the aperture yet allow the disk to pivot into an open position to allow insertion/removal of a beverage container when sufficient force is applied thereto. Various approaches may be taken to accomplish the objective of providing a retaining means that enables convenient installation of a longneck beverage container into the insulated beverage container holder disclosed herein yet provides a retaining mechanism to prevent accidental escape of the longneck container from within the holder.

All of the embodiments disclosed herein are constructed from materials well known in the art of insulated beverage holders, including open cell foam, closed cell foam, vinyl coated soft foam or any other material known in the art having resilient and compressible characteristics as well as desirable insulating properties.

The longneck bottle commonly used in the beverage industry offers a long cushion of air to absorb the pressure of carbonation and reduce the risk of exploding. It is not expected that this beverage container will fall into disuse, thus the invention disclosed is expected to enjoy a long period of use.

While the invention has been illustrated and described in detail in the drawings and foregoing description of the preferred embodiments, the same is to be considered as illustrative and not restrictive in character, it being understood that only the preferred embodiments have been shown and described and that all changes and modifications that come within the spirit of the invention are desired to be protected.

What is claimed is:

1. A one-piece, insulating container for use with a cylindrical beverage can and a cylindrical longneck beverage bottle having a neck portion and a base portion, said insulating container comprising:

a top surface;

a bottom surface;

a lateral surface;

a first cylindrical aperture defined by said lateral surface and said bottom surface, wherein the first cylindrical aperture is configured to receive at least a portion of the beverage can and cause an interference fit with the beverage can;

a second cylindrical aperture partially defined by said top surface, wherein the second cylindrical aperture is configured to receive at least a portion of the neck portion of the longneck beverage bottle and cause an interference fit with the neck portion and wherein said second cylindrical aperture is axially aligned with said first cylindrical aperture; and a third cylindrical aperture partially defined by said lateral surface and axially aligned with said first and second cylindrical apertures, said third cylindrical aperture adjacent said first and second cylindrical apertures, wherein said third cylindrical aperture is configured to receive at least a portion of the base portion of the longneck beverage bottle and cause an interface fit with the base portion, wherein the lateral surface comprises a shoulder at the intersection of the first and third cylindrical apertures, said shoulder is configured to at least partially support the beverage can within the container.

2. The one-piece, insulating container of claim 1 wherein said lateral surface is cylindrical.

3. The one-piece, insulating container of claim 2 further comprising means for retaining the longneck beverage bottle removably attached to said bottom surface and adapted to securely maintain the position of the longneck beverage bottle situated in said first, second, and third cylindrical apertures.

4. The one-piece, insulating container of claim 3 wherein said means for retaining includes a planar member and a hook and loop fastener attached to said planar member, and wherein said planar member is removably attached to the bottom surface.

5. The one-piece, insulating container of claim 3 wherein said means for retaining includes a resilient strap situated over at least a portion of said bottom surface.

6. The one-piece, insulating container of claim 5 wherein said strap is removably attached to said bottom surface.

7. An one-piece, insulated beverage holder for use with a cylindrical beverage can having a diameter and a height and a cylindrical longneck beverage bottle having a cylindrical neck portion with a neck portion diameter and a bottle base portion with a bottle base diameter that is larger than the neck portion diameter yet smaller than the diameter of the cylindrical beverage can, said insulating beverage holder comprising:

a top surface and a bottom surface, wherein said top surface and said bottom surface are planar surfaces situated in spaced apart parallel planes a lateral surface;

a first cylindrical aperture defined by said lateral surface and said bottom surface and having a diameter sized for an interference fit with the beverage can, said first cylindrical aperture having a height that is less than the height of the cylindrical beverage can;

a second cylindrical aperture partially defined by said top surface and having a diameter sized for an interference fit with the neck portion of the longneck beverage bottle, said second cylindrical aperture having a height less than the neck portion of the longneck beverage bottle and wherein said second cylindrical aperture is axially aligned with said first cylindrical aperture;

a third cylindrical aperture partially defined by said lateral surface and axially aligned with said first and second cylindrical apertures, said third cylindrical aperture adjacent said first and second cylindrical apertures, said third cylindrical aperture having a diameter sized for an interference fit with the bottle base portion of the longneck beverage bottle wherein the lateral surface comprises a shoulder at the intersection of the first and third cylindrical apertures, said shoulder is configured to at least partially support the beverage can within the beverage holder.

8. The device of claim 7 including a beverage retaining means for capturing a beverage container within said first cylindrical aperture.

9. The device of claim 8 wherein said beverage retaining means is a planar member removably attached to said bottom surface.

10. The device of claim 8 wherein said beverage retaining means is a planar member hingedly attached to said bottom surface.

11. The device of claim 8 wherein said beverage retaining means is a resilient strap situated over said bottom surface.

12. A one-piece, insulating beverage container holder for use with a cylindrical beverage container having a diameter and a height and a longneck beverage container having a cylindrical neck portion with a neck portion diameter and a bottle diameter that is larger than the neck portion diameter yet smaller than the diameter of the cylindrical beverage container, said insulating beverage container holder comprising:

a one-piece body consisting of a flexible resilient insulating material and having a top surface and a bottom surface and wherein said top surface and said bottom surface are planar surfaces disposed in spaced apart parallel planes;

a first aperture disposed in said bottom surface of said body that is sized for an interference fit with the diameter of the cylindrical beverage container;

a second aperture disposed in said top surface of said body that is sized for an interference fit with the diameter of the neck portion of the longneck beverage container; and a third aperture situated within said body and in fluid communication with said first and said second apertures, and wherein said third aperture is sized for an interference fit with the bottle diameter of the longneck beverage container, wherein the body further comprises a shoulder at the intersection of the first and third cylindrical apertures, said shoulder is configured to at least partially support the cylindrical beverage container within the beverage container holder.

13. The insulating beverage container holder of claim 12 wherein said first, said second, and said third apertures are substantially cylindrical in shape and substantially axially aligned with one another.

14. The insulating beverage container holder of claim 13 wherein said body is fabricated from a closed-cell foam insulating material.

15. The insulating beverage container holder of claim 13 wherein said body is fabricated from an open-cell foam insulating material.

16. The insulating beverage container holder of claim 13 including a retaining means for securely retaining a beverage container within said first cylindrical aperture of said body, and wherein said retaining means is removably attached to said bottom surface of said body and disposed over said first aperture of said body.

17. The insulating beverage container holder of claim 16 wherein said retaining means is a disk shaped member removably attached to said bottom surface of said cylindrical body over said first aperture.

18. The insulating beverage container holder of claim 17 including a hook and loop fastener having a first portion thereof attached to said disk and a second portion thereof attached to said bottom surface for removable attachment of said disk shaped member to said bottom surface of said body.

* * * * *